United States Patent [19]

Wissinger

[11] Patent Number: 4,817,344

[45] Date of Patent: Apr. 4, 1989

[54] BATHTUB WALL SURROUND KIT

[75] Inventor: John W. Wissinger, New Castle, Pa.

[73] Assignee: Universal-Rundle Corporation, New Castle, Pa.

[21] Appl. No.: 126,835

[22] Filed: Nov. 30, 1987

[51] Int. Cl.[4] ..... A47K 3/16

[52] U.S. Cl. ..... 52/35; 52/582; 52/588

[58] Field of Search ..... 52/35, 288, 582, 588

[56] References Cited

FOREIGN PATENT DOCUMENTS 3318116 11/1984 Fed. Rep. of Germany ..... 52/35

*Primary Examiner*—Carl D. Friedman
*Assistant Examiner*—J. Johnson
*Attorney, Agent, or Firm*—Wood, Dalton, Phillips, Mason & Rowe

[57] ABSTRACT

A bathtub wall surround kit is disclosed. The kit includes a plurality of panels adapted to be secured to the walls of a bathtub opening with each of the panels having a vertical edge adapted to be disposed in overlapping relation to a corresponding vertical edge of the next adjacent of the panels. It also includes a plurality of vertical seals for joining the corresponding vertical edges of the overlapping panels in substantially watertight fashion where each of the vertical seals includes a panel-receiving channel formed by a pair of spaced apart walls joined by a channel-defining bottom wall along with a seal adapted to cooperate with the overlapping panels. The kit further includes a continuous base seal for joining the bottom edges of the panels to a rim of a bathtub in substantially watertight fashion with the base seal including a wall portion adapted to be secured to the walls of a bathtub opening and a base portion adapted to be disposed in sealing engagement with the rim of the bathtub together with at least one downwardly and outwardly projecting flexible finger associated with each of the wall and base portions. With this arrangement, the bathtub wall surround kit eliminates the need for the installer to caulk the joints during or after installation.

20 Claims, 2 Drawing Sheets

BATHTUB WALL SURROUND KIT

DESCRIPTION

BACKGROUND OF THE INVENTION

The present invention relates to means for covering the end walls and side wall of a bathtub opening and, more particularly, relates to a bathtub wall surround kit to facilitate installation and maintenance.

In the past, various means for covering the end walls and side wall of a bathtub enclosure have been proposed. It has been common, for instance, for such walls to be covered with ceramic tile, although this is far less common today due to the fact that ceramic tile oftentimes requires extensive maintenance in the form of replacing and regrouting loose or missing tiles and is difficult to clean in a satisfactory fashion capable of removing soap residue and eliminating mildew without damaging the tile surface. More recently, bathtub wall surrounds have been formed of fiberglass or plastic to avoid these problems.

Conventional bathtub wall surrounds usually consist of either three or five pieces. The three-piece wall surround usually includes a pair of L-shaped end panels and a single side panel whereas the five-piece wall surround may include a pair of end panels, a pair of L-shaped corner panels and a side panel. With these arrangements, the panels are usually attached to the building walls with panel adhesive.

Unfortunately, with both three-piece and five piece wall surrounds, the joints between the panels must be sealed with caulk. It is also necessary to caulk the joint between the wall panels and the rim of the tub in order to avoid water damage and to provide the requisite seal. However, caulk is difficult to apply, tends to mildew and dry out after several years, and must be replaced.

Other types of wall surrounds have included three panels which may be flat or formed with soap shelves, grab bars or surface decoration. The panels are then connected by a V-shaped plastic extrusion having a slot in each leg of the extrusion but, in order to make the surround watertight, it is necessary to caulk the joint between the panels and the extrusions and, again, between the panels and the rim of the tub. Still other variations requiring caulk include a design where the side wall is in two pieces joined by an H-shaped plastic extrusion.

In order to overcome such problems, I developed an entirely unique bathtub wall surround kit as described in commonly owned U.S. Pat. No. 4,671,026. The kit so described overcomes the problems discussed hereinabove by providing a kit which, for the first time, facilitated installation and maintenance without the need of caulking any joints. With the present invention, an improvement has been provided in bathtub wall surround kits that also does not require caulking when or after it is installed.

SUMMARY OF THE INVENTION

Accordingly, the present invention is directed to a bathtub wall surround kit including a plurality of panels adapted to be secured to the walls of a bathtub opening with each of the panels having a vertical edge adapted to be disposed in overlapping relation to a corresponding vertical edge of the next adjacent of the panels. The kit includes a plurality of vertical seals for joining the corresponding vertical edges of the overlapping panels in substantially watertight fashion. Each of the vertical seals includes a panel-receiving channel formed by a pair of spaced apart walls joined by a channel-defining bottom wall and also includes seal means adapted to cooperate with the overlapping panels. The kit also contemplates the pair of spaced apart walls of each of the vertical seals including a back wall and a front wall. Each of the vertical seals has the back wall disposed between the overlapping panels and the front wall tapering toward the back wall such that the front wall is movable toward and away from the back wall. The kit also contemplates the seal means of each of the vertical seals comprising a flexible finger inwardly of the channel and a flexible finger outwardly of the channel. Each of the inward flexible fingers extends from one of the walls so as to sealingly engage a surface of the outermost of the corresponding ones of the overlapping panels whereas each of the outward flexible fingers extends from one of the walls so as to sealingly engage the outwardly facing surface of the innermost of the corresponding ones of the overlapping panels. The kit further includes means for securing each of the vertical seals to the innermost of the corresponding ones of the overlapping panels after the vertical edge of the outermost of the corresponding ones of the overlapping panels has been placed in the channel. Additionally, the bathtub wall surround kit includes a base seal for joining the bottom edges of the panels to a rim of a bathtub in substantially watertight fashion.

In a preferred embodiment, the seal means of each of the vertical seals includes a plurality of flexible fingers inwardly of the channel and extending from the inner surface of the front wall toward the back wall thereof. These flexible fingers are adapted to sealingly engage the outwardly facing surface of the outermost of the corresponding ones of the overlapping panels in substantially watertight fashion. Also, the seal means of each of the vertical seals preferably includes a plurality of flexible fingers inwardly of the channel and extending from the inner surface of the back wall toward the front wall thereof. These flexible fingers are adapted to sealingly engage the inwardly facing surface of the outermost of the corresponding ones of the overlapping panels in substantially watertight fashion. Still further, the seal means of each of the vertical seals preferably includes a primary seal associated with the channel-defining bottom wall and a secondary seal associated with the back wall of the seal.

Advantageously, the primary seal includes a finger-supporting extension disposed so as to extend toward the outwardly facing surface of the innermost of the corresponding ones of the overlapping panels. Furthermore, the outward flexible finger is preferably integral therewith. Moreover, the outward flexible finger is preferably a continuation of the extension adapted to sealingly engage the outwardly facing surface of the innermost of the corresponding ones of the overlapping panels in substantially watertight fashion.

Also, advantageously, the secondary seal includes a second outward flexible finger extending from the back wall toward the outwardly facing surface of the innermost of the corresponding ones of the overlapping panels. The second outward flexible finger is preferably integral with the back wall of the vertical seal. Moreover, the second outward flexible finger is also adapted to sealingly engage the outwardly facing surface of the innermost of the corresponding ones of the overlapping panels in substantially watertight fashion.

One feature of the present invention includes the securing means comprising a double-faced pressure sensitive adhesive tape disposed on the back wall of each of the vertical seals outwardly of the channel. Preferably, the tape is adapted to sealingly adhere to the outwardly facing surface of the innermost of the corresponding ones of the overlapping panels in substantially watertight fashion.

Another feature of the present invention includes the secondary seal associated with the back wall of each of the vertical seals comprising a pair of flexible fingers outwardly of the channel. The pair of flexible fingers extend from the back wall toward the outwardly facing surface of the innermost of the corresponding ones of the overlapping panels in spaced relation to one another with the double-faced pressure sensitive adhesive tape disposed therebetween and spaced inwardly of the primary seal. With this arrangement, the pair of flexible fingers are adapted to sealingly engage the outwardly facing surface of the innermost of the corresponding ones of the overlapping panels in substantially watertight fashion.

In an exemplary embodiment, each of the vertical seals is formed such that the back wall is longer than the front wall thereof. The portion of the back wall extending beyond the front wall is stepped outwardly to restrict the opening into the channel with one of the pair of flexible fingers comprising the secondary seal extending from the outwardly stepped portion of the back wall and the other of the pair of flexible fingers comprising the secondary seal extending substantially from the point where the back wall is joined to the bottom wall of the channel. Preferably, the double-faced pressure sensitive adhesive tape is disposed on the back wall outwardly of the channel between the pair of flexible fingers comprising the secondary seal.

In another respect, the present invention includes a continuous base seal for joining the bottom edges of the panels to a rim of a bathtub in substantially watertight fashion. The base seal includes a wall portion adapted to be secured to the walls of the bathtub opening and a base portion adapted to be disposed in sealing engagement with the rim of the bathtub. Advantageously, the base seal includes at least one downwardly and outwardly projecting flexible finger associated with each of the wall and base portions.

In the preferred embodiment, the base portion is generally rectangular in cross-section, is defined by a front wall, a back wall, a top wall and a bottom wall, and includes a pair of flexible fingers integral with the bottom wall. The outermost of the flexible fingers is preferably disposed at a first angle to the bottom wall of the base portion and the innermost of the flexible fingers is disposed at a second, greater angle to the bottom wall of the base portion. Advantageously, the flexible fingers define a recess coextensive with the bottom wall of the base portion within which the innermost of the flexible fingers is adapted to fit while in contact with the rim of the bathtub while the base portion is in sealing engagement therewith.

Preferably, the wall portion is generally planar and extends vertically from the base portion. The wall portion then includes at least one flexible finger integral therewith and adapted to be in contact with the inwardly facing surfaces of the panels in substantially watertight fashion. Moreover, the flexible finger projects downwardly and outwardly intermediate the top and bottom of the wall portion.

With regard to the base seal, means are provided for securing the panels to the base seal including a double faced pressure sensitive adhesive tape. This tape is disposed on the wall portion above the flexible finger. Further, the tape is advantageously adapted to sealingly adhere to the inwardly facing surfaces of the panels in substantially watertight fashion.

Other objects, advantages and features of the present invention will become apparent from a consideration of the detailed description when taken in conjunction with the accompanying drawings.

DETAILED DESCRIPTION OF THE PREFERRED EMBODIMENT

Figure 1:
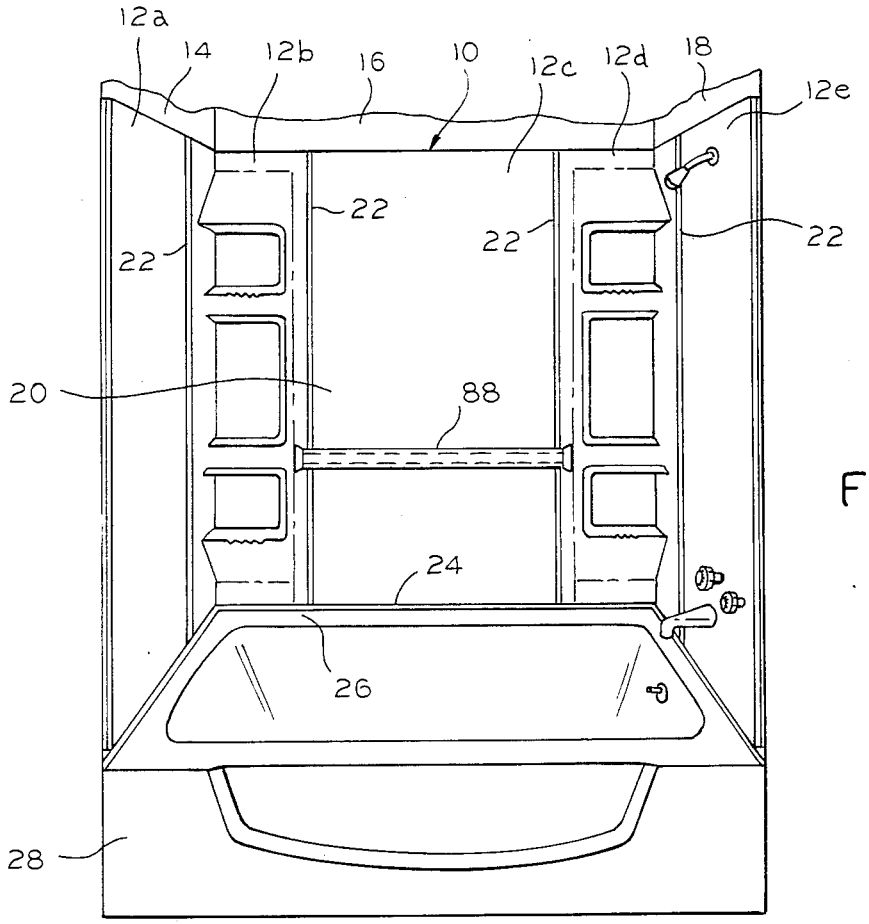
FIG. 1 is a perspective view of an installed bathtub wall surround kit in accordance with the present invention.

In the illustration given, and with reference first to FIG. 1, the reference numeral 10 designates generally a bathtub wall surround kit in accordance with the present invention. The bathtub wall surround kit 10 includes a plurality of panels 12*a*–12*e* (see, also, FIG. 2) secured to the walls 14,16 and 18 of a bathtub opening 20 with each of the panels having vertical edges 12*a*′–12*e*′ adapted to be disposed in overlapping relation to a corresponding vertical edge of the next adjacent of the panels 12*a*–12*e*. The kit 10 also includes a plurality of vertical seals 22 for joining the corresponding vertical edges 12*a*′–12*e*′ of the overlapping panels 12*a*–12*e* in substantially watertight fashion and a base seal 24 for joining the bottom edges 12*a*″–12*e*″ of the panels 12*a*–12*e* to a rim 26 of a bathtub 28 in substantially watertight fashion. Moreover, in accordance with the invention, the bathtub wall surround kit 10 need never be caulked during or at any time subsequent to installation.

Figure 3:
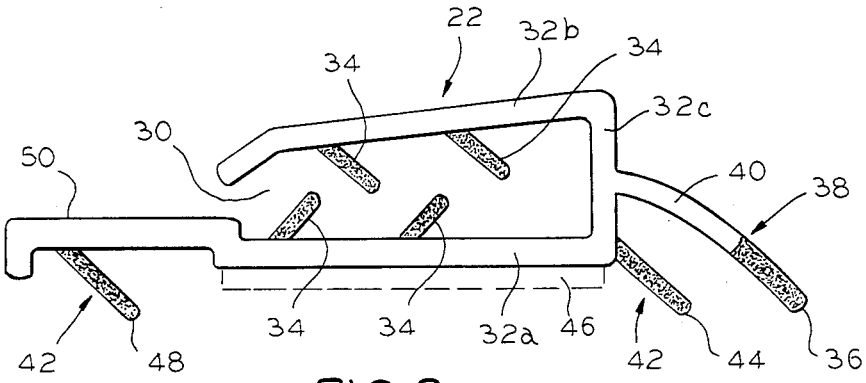
FIG. 3 is a cross-sectional view of a vertical seal for the bathtub wall surround kit of FIG. 1.

Referring specifically to FIG. 3, each of the vertical seals 22 includes a panel receiving channel 30 formed by a pair of spaced apart walls 32*a* and 32*b* joined by a channel-defining bottom wall 32*c* together with seal means adapted to cooperate with the overlapping panels 12*a*–12*e*. The pair of spaced apart walls 32*a* and 32*b* of each of the vertical seals 22 comprises a back wall 32*a* and a front wall 32*b*. Additionally, each of the vertical seals 22 has the back wall 32*a* disposed between the overlapping panels with the front wall 32*b* tapering toward the back wall 32*a* in a manner being movable toward and away from the back wall 32*a* (see, also, FIG. 3*a*).

Figure 3A:
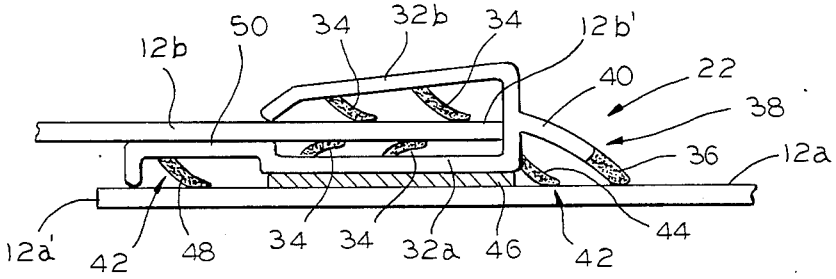
FIG. 3*a* is a cross-sectional view of an installed vertical seal of the bathtub wall surround kit of FIG. 1.

Still referring to FIGS. 3 and 3*a*, each of the vertical seals 22 is formed such that the seal means includes at least one flexible finger 34 inwardly of the channel 30 and extending from one of the walls 32*a*–32*c* so as to sealingly engage a surface of the outermost of the corresponding ones of the overlapping panels 12*a*–12*e*. Additionally, each of the vertical seals 22 is formed such that the seal means includes at least one flexible finger such as 36 outwardly of the channel 30 and extending from one of the walls 32a–32c so as to sealingly engage the outwardly facing surface of the innermost of the corresponding ones of the overlapping panels 12a–12e.

As also shown in FIGS. 3 and 3a, means are provided for securing each of the vertical seals 22 to the innermost of the corresponding ones of the overlapping panels 12a–12e, e.g., 12a, after the vertical edge, e.g., 12b', of the outermost of the corresponding ones of the overlapping panels, e.g., 12b has been placed in the channel 30, as will be discussed in greater detail hereinafter Preferably, the seal means of each of the vertical seals 22 includes a plurality of flexible fingers 34 inwardly of the channel 30 and extending from the inner surface of the back wall 32a toward the front wall 32b thereof. These flexible fingers 34 are adapted to sealingly engage the inwardly facing surface of the outermost of the corresponding ones of the overlapping panels, e.g., 12b, in substantially watertight fashion. Also, preferably, the seal means of each of the vertical seals 22 includes a plurality of flexible fingers 34 inwardly of the channel 30 and extending from the inner surface of the front wall 32b toward the back wall 32a thereof. These flexible fingers 34 are adapted to sealingly engage the outwardly facing surface of the outermost of the corresponding ones of the overlapping panels, e.g., 12b in substantially watertight fashion.

As shown, the seal means of each of the vertical seals 22 includes a primary seal generally designated 38 which is associated with the channel-defining bottom wall 32c. The primary seal 38 includes a finger-supporting extension 40 disposed so as to extend toward the outwardly facing surface of the innermost of the corresponding ones of the overlapping panels, e.g., 12a and the outward flexible finger 36 is integral therewith. In addition, the outward flexible finger 36 comprises a continuation of the extension 40 adapted to sealingly engage the outwardly facing surface of the innermost of the corresponding ones of the overlapping panels, e.g., 12b in substantially watertight fashion.

Still referring to FIGS. 3 and 3a, the seal means of each of the vertical seals 22 also includes a secondary seal generally designated 42 which is associated with the back wall 32a thereof. The secondary seal 42 preferably includes at least a second outward flexible finger 44 extending from the back wall 32a toward the outwardly facing surface of the innermost of the corresponding ones of the overlapping panels, e.g., 12a. As will be appreciated, the second outward flexible finger 44 is adapted to sealingly engage the outwardly facing surface of the innermost of the corresponding ones of the overlapping panels, e.g., 12a, in substantially watertight fashion.

As for the securing means mentioned above, it preferably includes a double-faced pressure sensitive adhesive tape 46 disposed on the back wall 32a of each of the vertical seals 22 outwardly of the channel 30. As shown in FIG. 3a, the tape 46 is adapted to sealingly adhere to the outwardly facing surface of the innermost of the corresponding ones of the overlapping panels, e.g., 12a, in substantially watertight fashion.

Referring to FIGS. 3 and 3a, the secondary seal 42 associated with the back wall 32a of each of the vertical seals 22 advantageously includes a pair of flexible fingers 44 and 48 outwardly of the channel 30. The pair of flexible fingers 44 and 48 extend from the back wall 32a toward the outwardly facing surface of the innermost of the coresponding ones of the overlapping panels, e.g., 12a, in spaced relation to one another with the tape 46 disposed therebetween and spaced inwardly of the primary seal 38. With this construction, the pair of flexible fingers 44 and 48 is adapted to sealingly engage the outwardly facing surface of the innermost of the corresponding ones of the overlapping panels, e.g., 12a in substantially watertight fashion.

As shown, each of the vertical seals 22 is preferably formed such that the back wall 32a is longer than the front wall 32b thereof. The portion of the back wall 32a extending beyond the front wall 32b is stepped outwardly as at 50 to restrict the opening into the channel 30 with one of the pair of flexible fingers 44 and 48 comprising the secondary seal 42 extending from the outwardly stepped portion of the back wall 32a and the other of the pair of flexible fingers 44 and 48 comprising the secondary seal 42 extending substantially from the point where the back wall 32a is joined to the bottom wall 32c of the channel 30. As previously suggested, the tape 46 is then disposed on the back wall 32a outwardly of the channel 30 between the pair of flexible fingers 44 and 48 comprising the secondary seal 42.

In the preferred embodiment, the back wall 32a, front wall 32b, bottom wall 32c and finger-supporting extension 40 are integrally formed of a semi-rigid plastic material and the flexible fingers 34,36,44 and 48 are integrally formed of a soft plastic material having flexible sealing characteristics.

Figure 2:
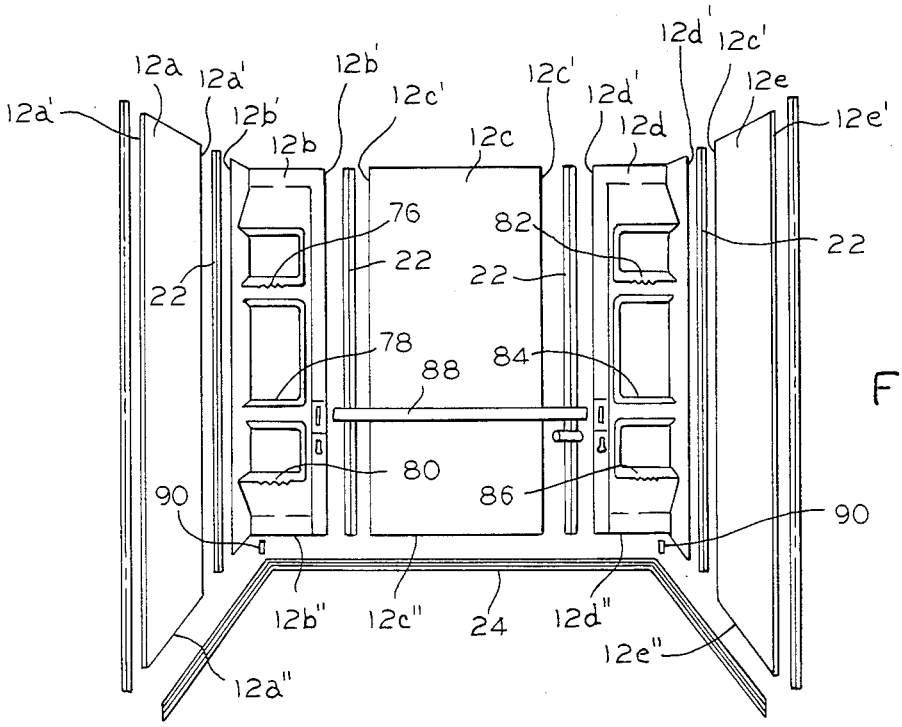
FIG. 2 is an exploded perspective view of the components of the bathtub wall surround kit of FIG. 1.
Figure 4:
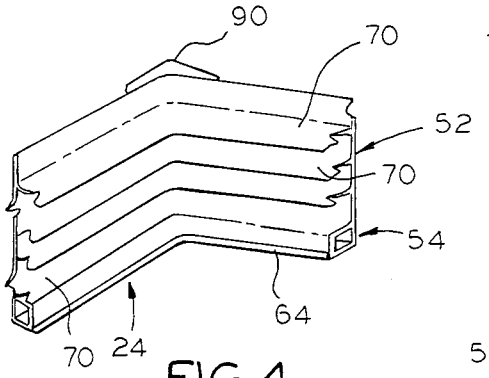
FIG. 4 is a perspective view of a base seal of the bathtub wall surround kit of FIG. 1.
Figure 5:
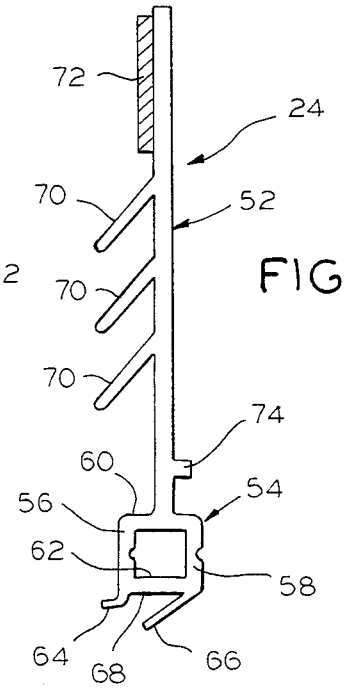
FIG. 5 is a cross-sectional view of the base seal of FIG. 4.

Referring now to FIGS. 2, 4 and 5, the base seal 24 is preferably continuous about the bottom edges of the panels 12a–12e. It will also be seen that the base seal 24 includes a wall portion 52 adapted to be secured to the walls 14,16 and 18 of the bathtub opening 20 and a base portion 54 adapted to be disposed in sealing engagement with the rim 26 of the bathtub 28. Additionally, the base seal 24 includes at least one downwardly and outwardly projecting finger associated with each of the wall and base portions 52 and 54.

As best illustrated in FIG. 5, the base portion 54 is generally rectangular in cross-section. Thus, the base portion 54 is defined by what can be considered a front wall 56, a back wall 58, a top wall 60 and a bottom wall 62. Preferably, a pair of flexible fingers 64 and 66 project downwardly and outwardly in integral relation with the bottom wall 62.

Still referring to FIG. 5, the outermost of the flexible fingers 64 is disposed at a first angle to the bottom wall 62 of the base portion 54 and the innermost of the flexible fingers 66 is disposed at a second, greater angle to the bottom wall 62 of the base portion 54. It will also be seen that the flexible fingers 64 and 66 define what in essence comprises a recess 68 coextensive with the bottom wall 62 of the base portion 54, and the innermost of the flexible fingers 66 is adapted to fit within the recess 68 in contact with the rim 26 of the bathtub 28 when the base portion 54 is in sealing engagement with the rim 26 of the bathtub 28. Still further, the outermost of the flexible fingers 64 extends outwardly of the base portion 54 so as to then also be in sealing contact with the rim 26 of the bathtub 28.

As shown in FIG. 5, the wall portion 52 is generally planar and extends vertically from the base portion 54. It will also be seen that the wall portion 52 includes at least one flexible finger 70 and preferably a plurality of flexible fingers 70 integral therewith and adapted to be in contact with the inwardly facing surfaces of the panels 12*a*–12*d* in substantially watertight fashion. Still further, the flexible finger or fingers 70 project downwardly and outwardly intermediate the top and bottom of the wall portion 52.

As shown in FIG. 5, the base seal 24 includes means for securing the panels 12*a*–12*e* thereto. In this connection, the securing means preferably includes a double faced pressure sensitive adhesive tape 72 disposed on the wall portion 52 above the flexible finger or fingers 70. As will be appreciated, the tape 72 is adapted to sealingly adhere to the inwardly facing surfaces of the panels 12*a*–12*e* in substantially watertight fashion.

In the preferred embodiment, the base seal 24 is formed of an extrusion of soft plastic material. The wall portion 52 projects upwardly from the top wall 60 of the base portion 54 intermediate the front and rear thereof and the panels 12*a*–12*e* will extend downwardly to a point below the flexible finger or fingers 70 but above the base portion 54. As shown, the wall portion 52 may also advantageously include a continuous rib 74 which projects inwardly to a point lying in a plane defined by the back wall 58 of the base portion 54.

Finally, means are provided for securing the base seal 24 to the walls 14,16 and 18 of the bathtub opening 20. The securing means preferably comprises still another double-faced pressure sensitive adhesive tape (not shown) of the type already disclosed in connection with the vertical seal (FIG. 3) as at 46 and in connection with the base seal 24 as at 72 but provided as a separate component. Still more particularly, the tape will be applied to be in contact with the walls 14,16 and 18 of the bathtub opening 20 and in contact with the rim 26 of the bathtub 28.

Referring to FIG. 2, the bathtub wall surround kit 10 preferably includes a pair of end panels 12*a* and 12*e*, a left corner panel 12*b*, a right corner panel 12*d*, and a side panel 12*c*. The corner panels 12*b* and 12*d* can then include various soap and utility shelves such as 76,78,80,82,84 and 86, as well as a grab bar 88 extending therebetween. Since the vertical seals 22 require the panels 12*a*–12*e* to overlap, there is a considerable degree of adjustability whereby the bathtub wall surround kit 10 can be used to fit within a wide variety of bathtub openings.

In installing the kit 10, the first step is to locate the top of the wall surround. Next, a corner block 90 is inserted in each corner of the bathtub opening 20 after which a roll of double-faced pressure sensitive adhesive tape is applied all the way around the walls of the bathtub opening just above the bathtub with the bottom edge just touching the rim thereof. Then, the base seal is applied to the wall by first pressing it down tightly against the rim of the bathtub and then into the double-faced pressure sure sensitive adhesive tape. Next, the end and side panels are installed on the walls of the bathtub opening by using a suitable adhesive. The bottom of the end panels and side panel are pressed into firm contact with the double-faced pressure sensitive adhesive tape so as to be adhesively secured to the base seal. Then, the vertical seals are placed on the vertical edges of the corner panels by inserting the vertical edges into the channels thereof. Next, the corner panels are adhesively secured to the walls of the bathtub opening and the bottom edges of all of the panels are pressed into firm contact with the double-pressure sensitive adhesive tape to be adhesively secured to the base seal. The vertical seals are then pressed into firm contact with the corresponding end and back panels to be adhesively secured thereto. Finally, the grab bar can be installed in a conventional manner.

As will be appreciated, the flexible fingers 64 and 66 of the base seal 24 contact the rim 26 of the tub 28 to effect a seal. This flexible extrusion is held in place by the double-faced pressure sensitive adhesive tape that also contacts the rim 26 of the bathtub 28 to effect a seal. In addition, by reason of the overlapping of the panels 12*a*–12*e* with the base seal 24, a shingle effect is provided.

With this shingle effect, the flexible fingers 70 prevent water from passing between the wall panels 12*a*–12*e* and the base seal 24. It will also be appreciated that the double-faced pressure sensitive adhesive tape 72 not only holds the base seal 24 and panels 12*a*–12*e* together, but also does so in a manner forming an additional watertight joint. As a result, the base seal 24 is highly effective in providing a watertight joint without the need for caulk.

In like fashion, the vertical seals 22 are highly effective for providing watertight joints This is accomplished by reason of the fact that the seals 22 include flexible fingers 34 which grip one of an adjacent pair of panels within the channel 30 while flexible fingers 36,44 and 48 sealingly engage the other of a pair of adjacent panels disposed in overlapping relation therewith. Moreover, the double-faced pressure sensitive adhesive tape 46 serves not only to hold the adjacent wall panels together but also to provide an additional watertight joint.

Various changes coming within the spirit of the present invention may suggest themselves to those skilled in the art. Hence, it will be understood that the invention is not to be limited to the specific embodiments shown and described or the uses mentioned. On the contrary, the specific embodiments and uses are intended to be merely exemplary with the present invention being limited only by the true spirit and scope of the appended claims.

I claim:

1. A bathtub wall surround kit, comprising:

a plurality of panels adapted to be secured to the walls of a bathtub opening and each having a vertical edge adapted to be disposed in overlapping relation to a corresponding vertical edge of the next adjacent of said panels;

a plurality of vertical seals for joining the corresponding vertical edges of said overlapping panels in substantially watertight fashion, each of said vertical seals including a panel-receiving channel formed by a pair of spaced apart walls joined by a channel-defining bottom wall, each of said vertical seals also including seal means adapted to cooperate with said overlapping panels;

said pair of spaced apart walls of each of said vertical seals including a back wall and a front wall, each of said vertical seals having said back wall disposed between said overlapping panels and having said front wall tapering toward said back wall, each of said vertical seals being formed such that said front wall is movable toward and away from said back wall;

each of said vertical seals being formed such that said seal means includes a flexible finger inwardly of said channel, each of said inward flexible fingers extending from one of said walls so as to sealingly engage a surface of the outermost of the corresponding ones of said overlapping panels;

each of said vertical seals also being formed such that said seal means includes a flexible finger outwardly of said channel, each of said outward flexible fingers extending from one of said walls so as to sealingly engage the outwardly facing surface of the innermost of the corresponding ones of said overlapping panels;

means for securing each of said vertical seals to the innermost of the corresponding ones of said overlapping panels after said vertical edge of the outermost of the corresponding ones of said overlapping panels has been placed in said channel; and a base seal for joining the bottom edges of said panels to a rim of a bathtub in substantially watertight fashion.

2. The bathtub wall surround kit as defined by claim 1 wherein said seal means of each of said vertical seals includes a plurality of flexible fingers inwardly of said channel and extending from the inner surface of said front wall toward said back wall thereof, said flexible fingers being adapted to sealingly engage the outwardly facing surface of the outermost of the corresponding ones of said overlapping panels in substantially watertight fashion.

3. The bathtub wall surround kit as defined by claim 1 wherein said seal means of each of said vertical seals includes a plurality of flexible fingers inwardly of said channel and extending from the inner surface of said back wall toward said front wall thereof, said flexible fingers being adapted to sealingly engage the inwardly facing surface of the outermost of the corresponding ones of said overlapping panels in substantially watertight fashion.

4. The bathtub wall surround kit as defined by claim 1 wherein said seal means of each of said vertical seals includes a primary seal associated with said channel-defining bottom wall, said primary seal including a finger-supporting extension disposed so as to extend toward the outwardly facing surface of the innermost of the corresponding ones of said overlapping panels and said outward flexible finger being integral therewith, said outward flexible finger being a continuation of said extension adapted to sealingly engage the outwardly facing surface of the innermost of the corresponding ones of said overlapping panels in substantially watertight fashion.

5. The bathtub wall surround kit as defined by claim 4 wherein said seal means of each of said vertical seals includes a secondary seal associated with said back wall of each of said vertical seals, said secondary seal including a second outward flexible finger extending from said back wall toward the outwardly facing surface of the innermost of the corresponding ones of said overlapping panels, said second outward flexible finger being adapted to sealingly engage the outwardly facing surface of the innermost of the corresponding ones of said overlapping panels in substantially watertight fashion.

6. The bathtub wall surround kit as defined by claim 1 wherein said securing means includes a double-faced pressure sensitive adhesive tape disposed on said back wall of each of said vertical seals outwardly of said channel, said tape being adapted to sealingly adhere to the outwardly facing surface of the innermost of the corresponding ones of said overlapping panels in substantially watertight fashion.

7. The bathtub wall surround kit as defined by claim 6 wherein said seal means of each of said vertical seals includes a primary seal associated with said channel-defining bottom wall, said primary seal including a finger-supporting extension disposed so as to extend toward the outwardly facing surface of the innermost of the corresponding ones of said overlapping panels and said outward flexible finger being integral therewith, said outward flexible finger being a continuation of said extension adapted to sealingly engage the outwardly facing surface of the innermost of the corresponding ones of said overlapping panels in substantially watertight fashion.

8. The bathtub wall surround kit as defined by claim 7 wherein said seal means of each of said vertical seals includes a secondary seal associated with said back wall of each of said vertical seals, said secondary seal including a second outward flexible finger extending from said back wall toward the outwardly facing surface of the innermost of the corresponding ones of said overlapping panels, said second outward flexible finger being adapted to sealingly engage the outwardly facing surface of the innermost of the corresponding ones of said overlapping panels in substantially watertight fashion.

9. The bathtub wall surround kit as defined by claim 8 wherein said secondary seal associated with said back wall of each of said vertical seals includes a pair of flexible fingers outwardly of said channel, said pair of flexible fingers extending from said back wall toward the outwardly facing surface of the innermost of the corresponding ones of said overlapping panels in spaced relation to one another with said tape disposed therebetween and spaced inwardly of said primary seal, said pair of flexible fingers being adapted to sealingly engage the outwardly facing surface of the innermost of the corresponding ones of said overlapping panels in substantially watertight fashion.

10. The bathtub wall surround kit as defined by claim 9 wherein each of said vertical seals is formed such that said back wall is longer than said front wall thereof, the portion of said back wall extending beyond said front wall being stepped outwardly to restrict the opening into said channel with one of said pair of flexible fingers comprising said secondary seal extending from said outwardly stepped portion of said back wall and the other of said pair of flexible fingers comprising said secondary seal extending substantially from the point where said back wall is joined to said bottom wall of said channel, said tape being disposed on said back wall outwardly of said channel between said pair of flexible fingers comprising said secondary seal.

11. The bathtub wall surround kit as defined by claim 10 wherein said front wall, back wall, bottom wall and finger-supporting extension are integrally formed of a semi-rigid plastic material and said flexible fingers are integrally formed of a soft plastic material.

12. A bathtub wall surround kit, comprising:

a plurality of panels adapted to be secured to the walls of a bathtub opening and each having a vertical edge adapted to be disposed in overlapping relation to a corresponding vertical edge of the next adjacent of said panels;

a plurality of vertical seals for joining the corresponding vertical edges of said overlapping panels in substantially watertight fashion, each of said vertical seals including a panel-receiving channel formed by a pair of spaced apart walls joined by a channel-defining bottom wall, each of said vertical seals also including seal means adapted to cooperate with said overlapping panels; and a continuous base seal for joining the bottom edges of said panels to a rim of a bathtub in substantially watertight fashion, said base seal including a wall portion adapted to be secured to the walls of a bathtub opening and a base portion adapted to be disposed in sealing engagement with the rim of the bathtub, said base seal including at least one downwardly and outwardly projecting finger associated with each of said wall and base portions.

13. The bathtub wall surround kit as defined by claim 12 wherein said base portion is generally rectangular in cross-section, said base portion being defined by a front wall, a back wall, a top wall, and a bottom wall, and including a pair of flexible fingers integral with said bottom wall.

14. The bathtub wall surround kit as defined by claim 13 wherein the outermost of said flexible fingers is disposed at a first angle to said bottom wall of said base portion and the innermost of said flexible fingers is disposed at a second, greater angle to said bottom wall of said base portion.

15. The bathtub wall surround kit as defined by claim 14 wherein said flexible fingers define a recess coextensive with said bottom wall of said base portion, the innermost of said flexible fingers being adapted to be fit within said recess in contact with the rim of the bathtub when said base portion is in sealing engagement with the rim of the bathtub, the outermost of said flexible fingers extending outwardly of said base portion in contact with the rim of the bathtub.

16. The bathtub wall surround kit as defined by claim 13 wherein said base seal is formed of an extrusion of soft plastic material, said wall portion projecting upwardly from said top wall of said base portion intermediate the front and rear thereof, said wall portion including a continuous rib projecting inwardly to a point lying in a plane defined by said back wall of said base portion.

17. The bathtub wall surround kit as defined by claim 12 wherein said wall portion is generally planar and extends vertically from said base portion, said wall portion including at least one flexible finger integral therewith and adapted to be in contact with the inwardly facing surfaces of said panels in substantially watertight fashion, said flexible finger projecting downwardly and outwardly intermediate the top and bottom of said wall portion.

18. The bathtub wall surround kit as defined by claim 17 including means for securing said panels to said base seal, said securing means including a double-faced pressure sensitive adhesive tape disposed on said wall portion above said flexible finger, said tape being adapted to sealingly adhere to the inwardly facing surfaces of said panels in substantially watertight fashion.

19. The bathtub wall surround kit as defined by claim 12 including means for securing said base seal to the walls of the bathtub opening, said securing means comprising a double-faced pressure sensitive adhesive tape, said tape being adapted to be disposed in contact with the walls of the bathtub opening and with the rim of the bathtub.

20. A bathtub wall surround kit, comprising:

a plurality of panels adapted to be secured to the walls of a bathtub opening and each having a vertical edge adapted to be disposed in overlapping relation to a corresponding vertical edge of the next adjacent of said panels;

a plurality of vertical seals for joining the corresponding vertical edges of said overlapping panels in substantially watertight fashion, each of said vertical seals including a panel-receiving channel formed by a pair of spaced apart walls joined by a channel-defining bottom wall, each of said vertical seals also including seal means adapted to cooperate with said overlapping panels;

said pair of spaced apart walls of each of said vertical seals including a back wall and a front wall, each of said vertical seals having said back wall disposed between said overlapping panels and having said front wall tapering toward said back wall, each of said vertical seals being formed such that said front wall is movable toward and away from said back wall;

each of said vertical seals being formed such that said seal means includes a flexible finger inwardly of said channel, each of said inward flexible fingers extending from one of said walls so as to sealingly engage a surface of the outermost of the corresponding ones of said overlapping panels;

each of said vertical seals also being formed such that said seal means includes a flexible finger outwardly of said channel, each of said outward flexible fingers extending from one of said walls so as to sealingly engage the outwardly facing surface of the innermost of the corresponding ones of said overlapping panels;

means for securing each of said vertical seals to the innermost of the corresponding ones of said overlapping panels after said vertical edge of the outermost of the corresponding ones of said overlapping panels has been placed in said channel; and a continuous base seal for joining the bottom edges of said panels to a rim of a bathtub in substantially watertight fashion, said base seal including a wall portion adapted to be secured to the walls of a bathtub opening and a base portion adapted to be disposed in sealing engagement with the rim of the bathtub, said base seal including at least one downwardly and outwardly projecting flexible finger associated with each of said wall and base portions.

* * * * *